US007796100B2

(12) United States Patent
Kim

(10) Patent No.: US 7,796,100 B2
(45) Date of Patent: Sep. 14, 2010

(54) ORGANIC ELECTROLUMINESCENCE DISPLAY AND DRIVING METHOD THEREOF

(75) Inventor: Hong Kwon Kim, Euiwang-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 704 days.

(21) Appl. No.: 11/651,017

(22) Filed: Jan. 9, 2007

(65) Prior Publication Data

US 2007/0279345 A1 Dec. 6, 2007

(30) Foreign Application Priority Data

Jun. 5, 2006 (KR) ..... 10-2006-0050484

(51) Int. Cl.
*G09G 3/30* (2006.01)

(52) U.S. Cl. ..... 345/77; 345/76; 345/204; 345/690; 315/169.3; 315/169.1

(58) Field of Classification Search ..... 345/76, 345/82–83, 77, 80, 690, 204; 315/169.3, 315/169.1

See application file for complete search history.

(56) References Cited

U.S. PATENT DOCUMENTS

| | | | | |
|---|---|---|---|---|
| 5,917,471 | A | 6/1999 | Choi | |
| 6,008,588 | A | 12/1999 | Fujii | |
| 2003/0214493 | A1 | 11/2003 | Akimoto et al. | |
| 2004/0056828 | A1* | 3/2004 | Choi et al. | 345/82 |
| 2004/0145597 | A1* | 7/2004 | Ito | 345/690 |
| 2004/0217925 | A1* | 11/2004 | Chung et al. | 345/76 |
| 2005/0046619 | A1 | 3/2005 | Senda et al. | |
| 2005/0083271 | A1* | 4/2005 | Suh et al. | 345/76 |
| 2005/0104815 | A1* | 5/2005 | Komiya et al. | 345/76 |
| 2005/0104875 | A1 | 5/2005 | Kwak et al. | |

(Continued)

FOREIGN PATENT DOCUMENTS

| | | |
|---|---|---|
| CN | 1622168 | 6/2005 |

(Continued)

OTHER PUBLICATIONS

U.S. Appl. No. 11/650,957, filed Jan. 2007, Kim, Samsung SDI Co., Ltd.

(Continued)

*Primary Examiner*—Douglas W Owens
*Assistant Examiner*—Ephrem Alemu
(74) *Attorney, Agent, or Firm*—Stein McEwen, LLP

(57) ABSTRACT

An organic electroluminescence display transmits a data driving voltage to a data driving unit to make different a voltage of the data signal outputted from the data driving unit, the data driving voltage being in a different level in every subframe according to the digital data signal, and displaying a desired grey level of an image by allowing a desired subframe to emit light according to the number of bits of the data signal, and a driving method thereof. An organic electroluminescence display includes a plurality of scan lines to transmit a scan signal; a plurality of data lines to transmit a digital data signal; and a plurality of pixels defined by a plurality of power supply lines to supply power, wherein the scan signal is transmitted to a plurality of subframes, and ON signals of the digital data signal have different voltages in a plurality of the subframes.

20 Claims, 6 Drawing Sheets

U.S. PATENT DOCUMENTS

| | | | |
|---|---|---|---|
| 2005/0259053 | A1 | 11/2005 | Iwabuchi |
| 2006/0061529 | A1 | 3/2006 | Kim |
| 2006/0077138 | A1 | 4/2006 | Kim |
| 2006/0092107 | A1 | 5/2006 | Kim |
| 2006/0092148 | A1 | 5/2006 | Ozawa et al. |

FOREIGN PATENT DOCUMENTS

| | | |
|---|---|---|
| CN | 1750100 | 3/2006 |
| EP | 0 762 374 | 3/1997 |
| JP | 9-114414 | 5/1997 |
| JP | 10-12381 | 1/1998 |
| JP | 10-232649 | 9/1998 |
| JP | 10-319909 | 12/1998 |
| JP | 2000-347622 | 12/2000 |
| JP | 2001-60076 | 3/2001 |
| JP | 2002-215096 | 7/2002 |
| JP | 2003-099000 | 4/2003 |
| JP | 2003-177680 | 6/2003 |
| JP | 2004-170815 | 6/2004 |
| JP | 2005-031630 | 2/2005 |
| JP | 2005-157349 | 6/2005 |
| JP | 2005-258407 | 9/2005 |
| JP | 2005-308897 | 11/2005 |
| JP | 2006-011368 | 1/2006 |
| JP | 2006-065282 | 3/2006 |
| JP | 2006-065286 | 3/2006 |
| JP | 2006-065328 | 3/2006 |
| JP | 2006-085141 | 3/2006 |
| JP | 2006-085169 | 3/2006 |
| JP | 2006-113548 | 4/2006 |
| JP | 2006-113586 | 4/2006 |
| JP | 2006-126778 | 5/2006 |
| JP | 2006-133731 | 5/2006 |
| JP | 2006-133745 | 5/2006 |
| KR | 2000-27755 | 5/2000 |
| KR | 10-2001-051967 | 6/2001 |
| KR | 2005-80318 | 8/2005 |
| KR | 10-2006-025283 | 3/2006 |
| KR | 2006-25285 | 3/2006 |
| KR | 10-602357 | 7/2006 |
| WO | WO 2005/076254 A1 | 8/2005 |
| WO | WO 2005/122120 A3 | 12/2005 |

OTHER PUBLICATIONS

Office Action issued May 31, 2007 by the Korean Intellectual Property Office re: Korean Patent Application No. 2006-50484 (4 pp).
Office Action issued by the Chinese Patent Office on Dec. 12, 2008.
Chinese Office Action dated Dec. 12, 2008, issued in corresponding Chinese Patent Application No. 200710108895.0.
Japanese Office Action dated Mar. 2, 2010, issued in corresponding Japanese Patent Application No. 2006-198643.
Japanese Office Action dated Mar. 2, 2010, issued in corresponding Japanese Patent Application No. 2006-198644.
European Search Report dated Mar. 25, 2010, issued in corresponding European Patent Application No. 07251605.7.
U.S. Office Action dated Apr. 15, 2010, issued in corresponding U.S. Appl. No. 11/650,957.
Communication issued by the European Patent Office on Apr. 26, 2010.

* cited by examiner

ORGANIC ELECTROLUMINESCENCE DISPLAY AND DRIVING METHOD THEREOF

CROSS-REFERENCE TO RELATED APPLICATION

This application claims the benefit of Korean Patent Application No. 2006-50484, filed on Jun. 5, 2006 in the Korean Intellectual Property Office, the disclosure of which is incorporated herein by reference.

BACKGROUND OF THE INVENTION

1. Field of the Invention

Aspects of the present invention relate to an organic electroluminescence display and a driving method thereof. More specifically, aspects of the present invention relate to an organic electroluminescence display and a driving method thereof that transmits a data driving voltage to a data driving unit to output different voltages of a digital data signal, the data driving voltage being a different voltage in every subframe according to the digital data signal. Accordingly, the organic electroluminescence display may display a desired grey level of an image by allowing a desired subframe to emit light corresponding to the number of bits of the digital data signal.

2. Description of the Related Art

Flat panel displays contain a plurality of pixels in a matrix arrangement on a substrate and has pixels set as a display area. In the flat panel displays, scan lines and data lines are connected to pixels to display an image by selectively applying data signals to the pixels.

The flat panel displays are classified into different type displays according to a driving mode of a pixel, including a passive matrix-type light-emitting display and an active matrix-type light-emitting display. The active matrix-type light-emitting display which emits light from every pixel has been used mainly due to better resolution, contrast, and operating speed.

Active matrix-type light-emitting displays are used as displays for such devices as a personal computer, a portable phone, PDA, etc., or as monitors of various information appliances even though various other types of flat panel displays are known in the art. Other types of flat panel displays include liquid crystal displays (LCDs) using a liquid crystal panel, organic electroluminescence displays using an organic electroluminescence device, and plasma display panels (PDPs) using a plasma panel, etc.

Recently, various light-emitting displays have been developed having a smaller weight and volume than a cathode ray tube, and attention has been particularly paid to organic electroluminescence displays which are excellent in luminous efficiency, luminance and viewing angles, and have rapid response times.

FIG. 1 is a view of a circuit showing a pixel used in one related art organic electroluminescence display. Referring to FIG. 1, the pixel is formed on a region where a data line (Dm) and a scan line (Sn) are crossed, and includes a first transistor (T11), a second transistor (T21), a capacitor (Cst), a compensation circuit 11, and an organic electroluminescence device (OLED). During operation, the pixel is selected by receiving a scan signal through the scan line (Sn), and a data signal is transmitted to the selected pixel through the data line (Dm) so that a luminance corresponding to the data signal is displayed. Also, each pixel is operated by receiving power from a first power supply (ELVdd) and a second power supply (ELVss).

The first transistor (T11) allows a current to flow from a source to a drain according to a signal applied to a gate electrode, and has a gate connected to the compensation circuit 11, a source connected to the first power supply (ELVdd), and a drain connected to the organic electroluminescence device (OLED).

The second transistor (T21) transmits a data signal to the compensation circuit 11 according the scan signal, and has a gate connected to the scan line (Sn), a source connected to the data line (Dm), and a drain connected to the compensation circuit 11.

The capacitor (Cst) applies a voltage to the compensation circuit 11 that corresponds to the data signal. The capacitor (Cst) maintains a voltage of the data signal during a predetermined period. Therefore, the first transistor (T11) allows a current that corresponds to the voltage of the data signal to flow during a predetermined period. As a result, even if the data signal is interrupted by the second transistor (T21), since the first electrode is connected to the first power supply (ELVdd) and the second electrode is connected to the compensation circuit 11, the second electrode maintains a voltage that corresponds to the data signal. Accordingly, the voltage that corresponds to the data signal is maintained on the gate of the first transistor (T11) during the predetermined period.

The compensation circuit 11 compensates for a threshold voltage of the first transistor (T11) by receiving a compensation control signal. Accordingly, the compensation circuit 11 prevents unevenness of a luminance due to unevenness of a threshold voltage. The compensation control signal may be transmitted by an additional signal line or may be transmitted by the scan line.

The organic electroluminescence device (OLED) has an organic film formed between an anode electrode and a cathode electrode so that the organic film is allowed to emit light. Light is emitted from the organic film if a current flows from the anode electrode to the cathode electrode. In the OLED shown in FIG. 1, the anode electrode is connected to the drain of the first transistor (T11) and the cathode electrode is connected to the second power supply (ELVss). The organic film includes an emitting layer (EML), an electron transport layer (ETL) and a hole transport layer (HTL). Also, the organic electroluminescence device may further include an electron injection layer (EIL) and a hole injection layer (HIL).

FIG. 2 is a view of a circuit showing another pixel used in a related art organic electroluminescence display. Referring to FIG. 2, the pixel includes a first transistor (T12), a second transistor (T22), a third transistor (T32), a fourth transistor (T42), a capacitor (Cst) and an organic electroluminescence device (OLED). The OLED shown is referred to as a current-driving pixel circuit for controlling a luminance using a current.

During operation of the current-driving pixel circuit, when the second transistor (T22) and the third transistor (T32) are in an ON state based on the scan signal, a current is generated in the first transistor (T12) that corresponds to a current flowing to the data line. At this time, a voltage corresponding to a capacity of the current is stored in the capacitor (Cst). Thereafter, when the second transistor (T22) and the third transistor (T32) are in an OFF state, the first transistor (T12) allows a current to flow to the organic electroluminescence device (OLED) due to the voltage stored in the capacitor (Cst). The current-driving pixel circuit as configured above does not have problems arising from an unevenness of a threshold voltage, etc., since the circuit uses the flowing current.

As described above, the pixel as shown in FIG. 1 should include a circuit for compensating for an uneven threshold voltage, while the pixel as shown in FIG. 2 is not suitable for a large screen of the organic electroluminescence display since time needed for charging by a current is increased due to a parasitic capacitor, etc., and since the driving circuit is more complicated.

SUMMARY OF THE INVENTION

Accordingly, aspects of the present invention include an organic electroluminescence display which transmits a data driving voltage to a data driving unit to make different a voltage of the digital data signal outputted from the data driving unit, the data driving voltage outputting the different voltages of the digital data signal, the data driving signal being different voltages in every subframe according to the digital data signal. The organic electroluminescence display displays a desired grey level of an image by allowing a desired subframe to emit light corresponding to the number of bits of the digital data signal, and a driving method thereof.

According to an aspect of the present invention an organic electroluminescence display includes a plurality of scan lines to transmit a scan signal; a plurality of data lines to transmit a digital data signal; and a plurality of pixels defined by a plurality of power supply lines to supply power, wherein the scan signal is transmitted during each of a plurality of subframes, and ON signals of the digital data signal have different voltages in each of the plurality of the subframes.

According to an aspect of the present invention an organic electroluminescence display includes a pixel unit including a plurality of pixels defined by, a plurality of scan lines to which a scan signal is transmitted, a plurality of data lines to which a digital data signal is transmitted, a plurality of emission control lines to which an emission control signal is transmitted, and a plurality of power supply lines to supply power; a data driving unit to receive an n-bit digital data signal to transmit each bit of the n-bit digital data signal to the data lines, wherein the data driving unit receives different data driving voltages during each of a plurality of subframes; a scan driving unit to transmit a scan signal that is transmitted during each of the plurality of the subframes, to the plurality of scan lines; and a control unit to generate the n-bit digital data signal and the different data driving voltages and to transmit the generated digital data signal and the different data driving voltages to the data driving unit.

According to an aspect of the present invention a method of driving an organic electroluminescence display includes classifying one frame into a plurality of subframes and transmitting a scan signal during each of the subframes; setting an ON-state voltage of an n-bit digital data signal to each of the subframes at a different voltage level; and determining a light-emitting subframe out of the plurality of subframes in accordance with a bit value of the n-bit digital signal.

According to an aspect of the present invention, a pixel of an electroluminescence device includes: a scan line to receive a scan signal; a data line to receive a data signal; and a transistor to control flow of current according to the data signal containing a data driving voltage component of different voltage levels to express brightness.

According to an aspect of the present invention, a method of driving a pixel of an electroluminescence device, includes: receiving a scan signal; receiving a data signal; and controlling the flow of current according to the data signal containing a data driving voltage component of different voltage levels to express brightness in the pixel.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the aspects, taken in conjunction with the accompanying drawings of which.

DETAILED DESCRIPTION OF THE EMBODIMENTS

Figure 1:
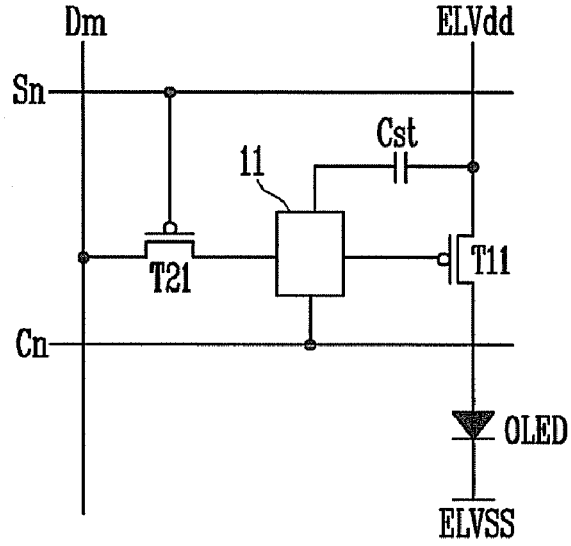
FIG. 1 (RELATED ART)
FIG. 1 is a view of a circuit showing a pixel used in a related art organic electroluminescence display.
Figure 2:
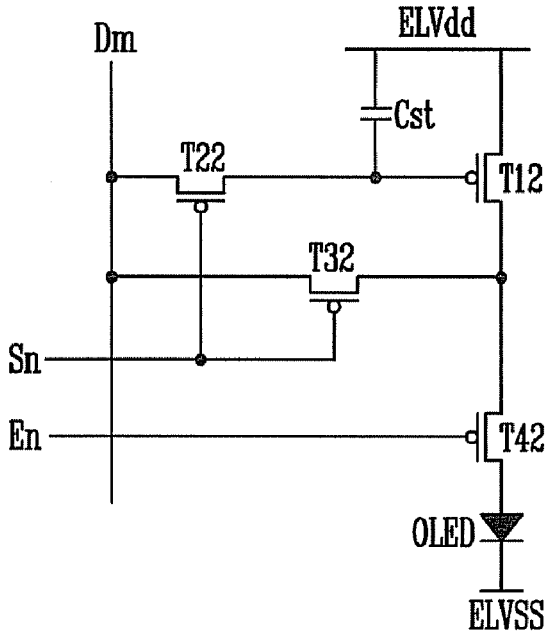
FIG. 2 (RELATED ART)
FIG. 2 is a view of a circuit showing another pixel used in a related art organic electroluminescence display.

Reference will now be made in detail to aspects of the present invention, examples of which are illustrated in the accompanying drawings, wherein like reference numerals refer to the like elements throughout. The aspects are described below in order to explain the aspects by referring to the figures.

Figure 3:
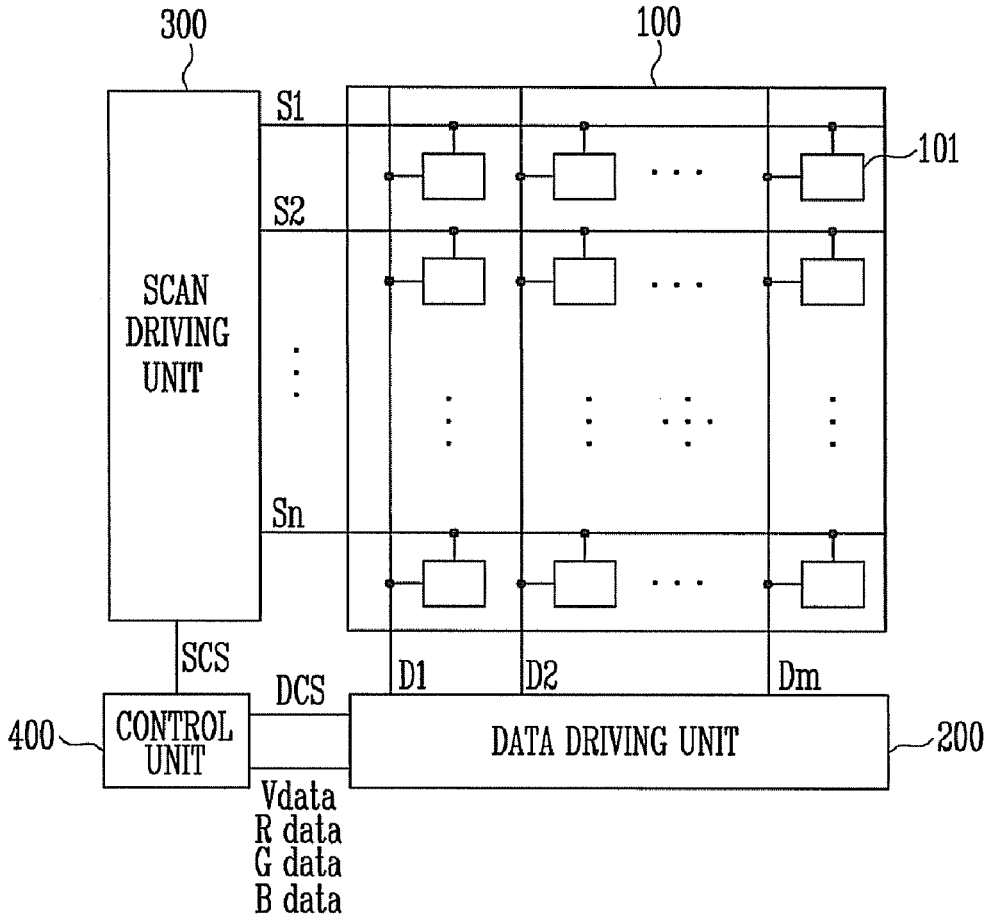
FIG. 3 is a schematic view showing a configuration of an organic electroluminescence display according to an aspect of the present invention.

FIG. 3 is a schematic view showing a configuration of an organic electroluminescence display according to an aspect of the present invention. Referring to FIG. 3, the organic electroluminescence display includes a pixel unit 100, a data driving unit 200, a scan driving unit 300, and a control unit 400.

As shown, the pixel unit 100 includes a plurality of data lines (D1,D2 . . . Dm−1,Dm) and a plurality of scan lines (S1,S2 . . . Sn−1,Sn). A plurality of pixels are formed in a region defined by the plurality of data lines (D1,D2 . . . Dm−1,Dm) and the plurality of scan lines (S1,S2 . . . Sn−1, Sn). As shown, the pixel 101 includes a pixel circuit and an organic electroluminescence device (not shown), and a pixel current is generated in the pixel circuit to flow to the organic electroluminescence device. The pixel current flows in the pixels 101 according to data signals transmitted through the plurality of data lines (D1,D2 . . . Dm−1,Dm) and scan signals transmitted through the plurality of scan lines (S1,S2 . . . Sn−1,Sn). During operation, each pixel 101 distinguishes a plurality of the subframes of the one frame. Also, a grey level displayed in the pixel 101 is determined by a sum of luminances emitted in (during) each period of the subframes.

The data driving unit 200 is connected with the plurality of data lines (D1,D2 . . . Dm−1,Dm) and generates n-bit digital data signals to be sequentially transmitted to the plurality of data lines (D1,D2 . . . Dm−1,Dm). The n-bit data signals generated in the data driving unit 200 is changed into a voltage in (during) every subframe according to a data driving voltage (Vdata). Therefore, output voltages of the digital data signal are transmitted according to each unit of the subframes.

The scan driving unit 300 is connected to the plurality of scan lines (S1,S2 . . . Sn−1,Sn) and generates scan signals to be transmitted to the plurality of scan lines (S1,S2 . . . Sn−1, Sn). Accordingly, the scan signals are transmitted according to each unit of the subframes, and then enable each row of the pixel unit 100 to be sequentially selected so that the digital data signals are transmitted into the selected rows of the plurality of scan lines (S1,S2 . . . Sn−1,Sn).

The control unit 400 transmits a data driving unit control signal (DCS), image signals (Rdata, Gdata, Bdata), a data driving voltage (Vdata), etc., to the data driving unit 200 to carry out an operation of the data driving unit 200, and transmits a scan driving unit control signal (SCS), etc., to the scan driving unit 300 to carry out an operation of the scan driving unit 300. Here, the image signals (Rdata, Gdata, Bdata) are transmitted as n-bit digital signals.

Figure 4:
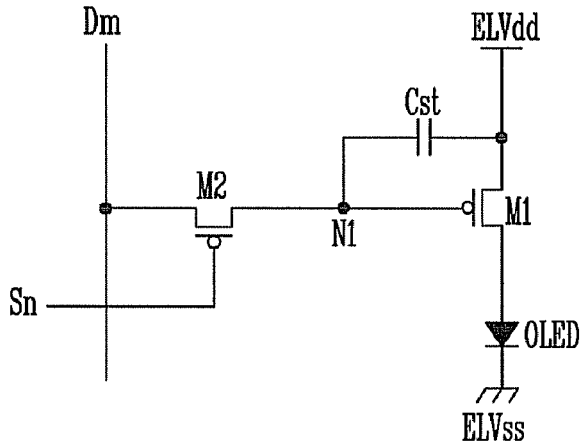
FIG. 4 is a view of a circuit showing one aspect of the pixel used in the organic electroluminescence display as shown in FIG. 3.

FIG. 4 is a view of a circuit showing one aspect of the pixel used in the organic electroluminescence display as shown in FIG. 3. As shown, the pixel includes a first transistor (M1), a second transistor (M2), a capacitor (Cst), and an organic electroluminescence device (OLED). In various aspects, the first and second transistors (M1 and M2) are implemented by a p-type metal-oxide semiconductor (PMOS) transistor. Nevertheless, it is understood that other types of transistors are usable.

As shown, the first transistor (M1) has a gate connected to the first node (N1), a source connected to the first power supply (ELVdd), and a drain connected to the organic electroluminescence device (OLED). Accordingly, a current flows from the first power supply (ELVdd) to the organic electroluminescence device (OLED) according to the voltage signal transmitted from the first node (N1).

The second transistor (M2) has a gate connected to the scan line (Sn), a source connected to the data line (Dm), and a drain connected to the first node (N1). Accordingly, the data signal from the data line (Dm) is transmitted to the first node (N1) according to the scan signal transmitted through the scan line (Sn).

The capacitor (Cst) has a first electrode connected to the first power supply (ELVdd), and a second electrode connected to the first node (N1) to maintain power of the first node (N1) during a predetermined period. Accordingly, the voltage of the data signal is maintained in the first node (N1) by the capacitor (Cst) even though the second transistor (M2) is in an OFF state.

The organic electroluminescence device (OLED) has an anode electrode (not shown), an organic film (not shown), and a cathode electrode (not shown). The organic film is controlled to emit light by having a current flow from the anode electrode to the cathode electrode of the OLED.

Figure 5:
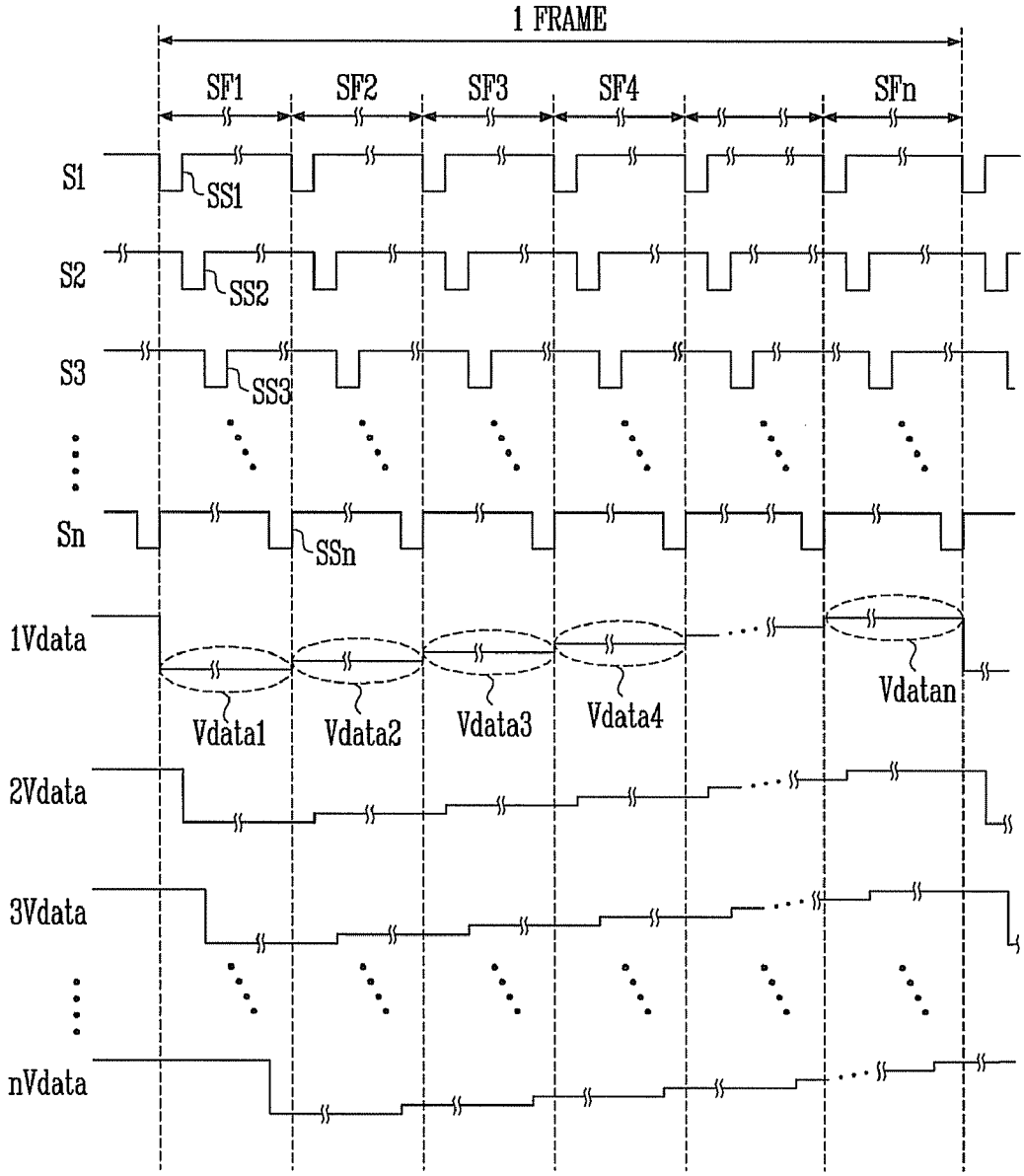
FIG. 5 is a waveform view showing a method of driving the pixel as shown in FIG. 4.

FIG. 5 is a waveform view showing a method of driving the pixel as shown in FIG. 4. As shown, one frame is divided into n number of subframes (SF1, SF2,SF3 . . . SFn) to correspond to an n-bit digital signal, and the n number of the subframes (SF1, SF2,SF3 . . . SFn) is used to display a grey level (grayscale level) in the organic electroluminescence device. During operation, the number n of the subframes (SF1, SF2, SF3 . . . SFn) has the grey levels corresponding to a different significance (levels) of brightnesses, and ratios of the grey levels corresponding to the brightnesses of the first to $n^{th}$ subframes (SF1, SF2,SF3 . . . SFn) are $2^0:2^1:2^2:2^3:2^4 \ldots 2^n$.

As shown in FIG. 5, a low state (low pulse) of the scan signals (SS1,SS2 . . . SSn−1,SSn) is sequentially supplied into each of the scan lines (S1,S2 . . . Sn−1,Sn) in (during) the first subframe (SF1) of the one frame, while the data driving unit simultaneously receives the data driving voltages (Vdata1, vdata2,vdata3 . . . vdatan) having different capacities (levels or values) in every subframe. That is, in the first subframe (SF1), the pixel receives the data driving voltage corresponding to the Vdata1. At this time, if a value of the first bit out of the n-bit data signal is set to "0," then a voltage of the data signal becomes "0". However, if a value of the first bit out of the n-bit data signal is set to "1," then a voltage of the data signal becomes the value of the data driving voltage, which in this case is Vdata1. Accordingly, when a low state (low pulse) of the scan signals (SS1,SS2 . . . SSn−1,SSn) is sequentially supplied, the second transistor (M2) connected to each of the scan lines (S1,S2 . . . Sn−1,Sn) are sequentially turned on. The first-bit digital data signal out of the n bits that are being supplied into the data signal are transmitted through the data line (Dm), and to the gate of each first transistor (M1), and each capacitor (Cst) stores a voltage difference of a voltage of the first-bit digital signal and a voltage of the first power supply (ELVdd).

Subsequently, if a high state (non-pulse) of a scan signal is supplied to the scan lines (S1,S2 . . . Sn−1,Sn), then the second transistor (M2) connected to the scan lines (S1,S2 . . . Sn−1,Sn) will be in an OFF state. However, since the first-bit digital data signal is stored in each capacitor (Cst), the first-bit digital data signal is continuously transmitted to the gate electrode of the first transistor (M1). A current corresponding to the first-bit digital data signal also continuously flows from a source to a drain of the first transistor (M1). Therefore, the first transistor (M1) emits light with a brightness corresponding to any one of "0" or "$2^0$" grey levels during the first subframe period.

As also shown in FIG. 5, low state of the scan signals (SS1,SS2 . . . SSn−1,SSn) are sequentially supplied into each of the scan lines (S1,S2 . . . Sn−1,Sn) in the second subframe (SF2) of the one frame, and the data driving unit simultaneously receives the data driving voltage (Vdata1,vdata2, vdata3 . . . vdatan) having different capacities (levels or values) in each of the subframes. That is, the second subframe (SF2) receives the data driving voltage corresponding to the Vdata2. During the operation, if a value of the second-bit digital data out of the n bits is set to "0", then a voltage of the data signal becomes "0". However, if a value of the second-bit digital data out of the n bits is set to "1," then a voltage of the data signal becomes the value of the data driving voltage, which in this case is Vdata2. Accordingly, when a low state (low pulse) of the scan signals (SS1,SS2 . . . SSn−1,SSn) is sequentially supplied, the second transistor (M2) connected to each of the scan lines (S1,S2 . . . Sn−1,Sn) is sequentially turned on. The second-bit digital data signal of the n bits that are supplied into the data signal, are transmitted through the data line (Dm) to the gate of each first transistor (M1), and each capacitor (Cst) stores a voltage difference of a voltage of the second-bit digital signal and a voltage of the first power supply (ELVdd).

Subsequently, if a high state (non-pulse) of a scan signal is supplied to the scan lines (S1,S2 . . . Sn−1,Sn), then the second transistor (M2) connected to the scan lines (S1,S2 . . . Sn−1,Sn) will be in an OFF state. However, since the second-bit digital data signal is stored in each capacitor (Cst), the second-bit digital data signal is continuously transmitted to the gate electrode of the first transistor (M1), and then a current corresponding to the second-bit digital data signal continuously flows in a direction from a source to a drain of the first transistor (M1). Therefore, the first transistor (M1) emits light with a brightness corresponding to any one of "0" or "$2^1$" grey levels during the second subframe period.

In the same manner, the organic electroluminescence device (OLED) transmits a current corresponding to the third-bit data signal and the data driving voltage, in (during) the third subframe (SF3) of the one frame, as described above. Therefore, the first transistor (M1) emits light with a brightness corresponding to any one of "0" or "$2^2$" grey levels also during the third subframe period.

Likewise, the fourth subframe period (SF4) to the $n^{th}$ subframe period (SFn) of the one frame are operated in the same manner as described above to transmit a current through the first transistor (M1) corresponding to the data signal and the data driving voltage. Accordingly, the first transistor (M1) emits light with a brightness corresponding to the data driving voltage and the fourth to $n^{th}$ bits.

Accordingly, the organic electroluminescence display according an aspect of the present invention and the driving method thereof displays a desired grey level that is a sum of the brightnesses corresponding to the emission of the organic electroluminescence device in each of the subframe by controlling a driving voltage that is transmitted to the data driving unit to every subframe.

Figure 6:
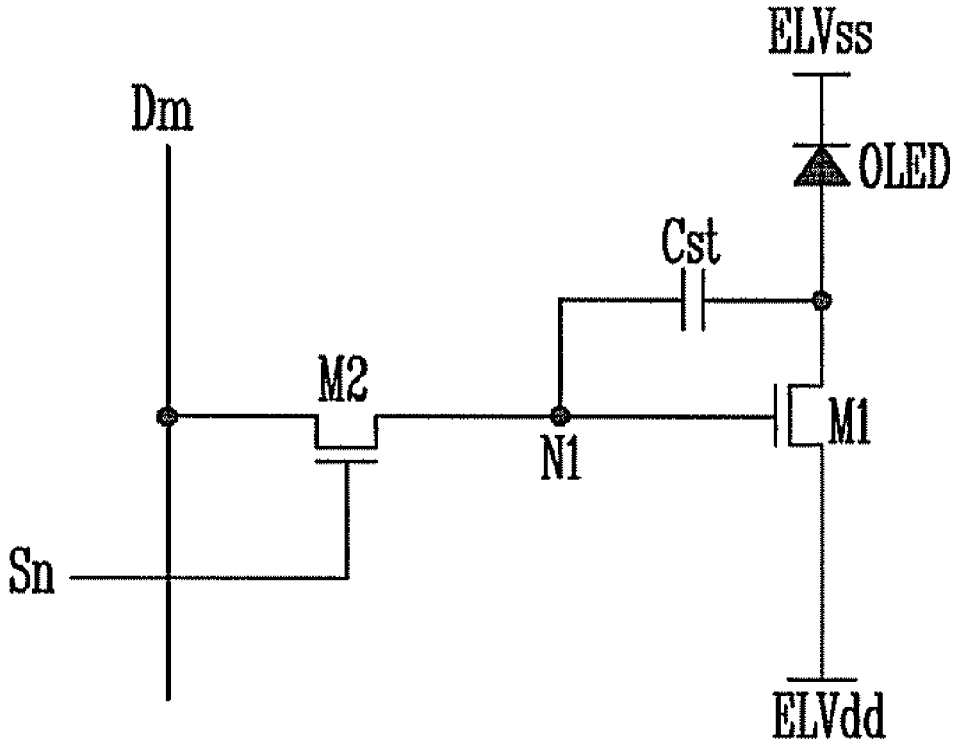
FIG. 6 is a view of a circuit showing another aspect of the pixel used in the organic electroluminescence display as shown in FIG. 3.
Figure 7:
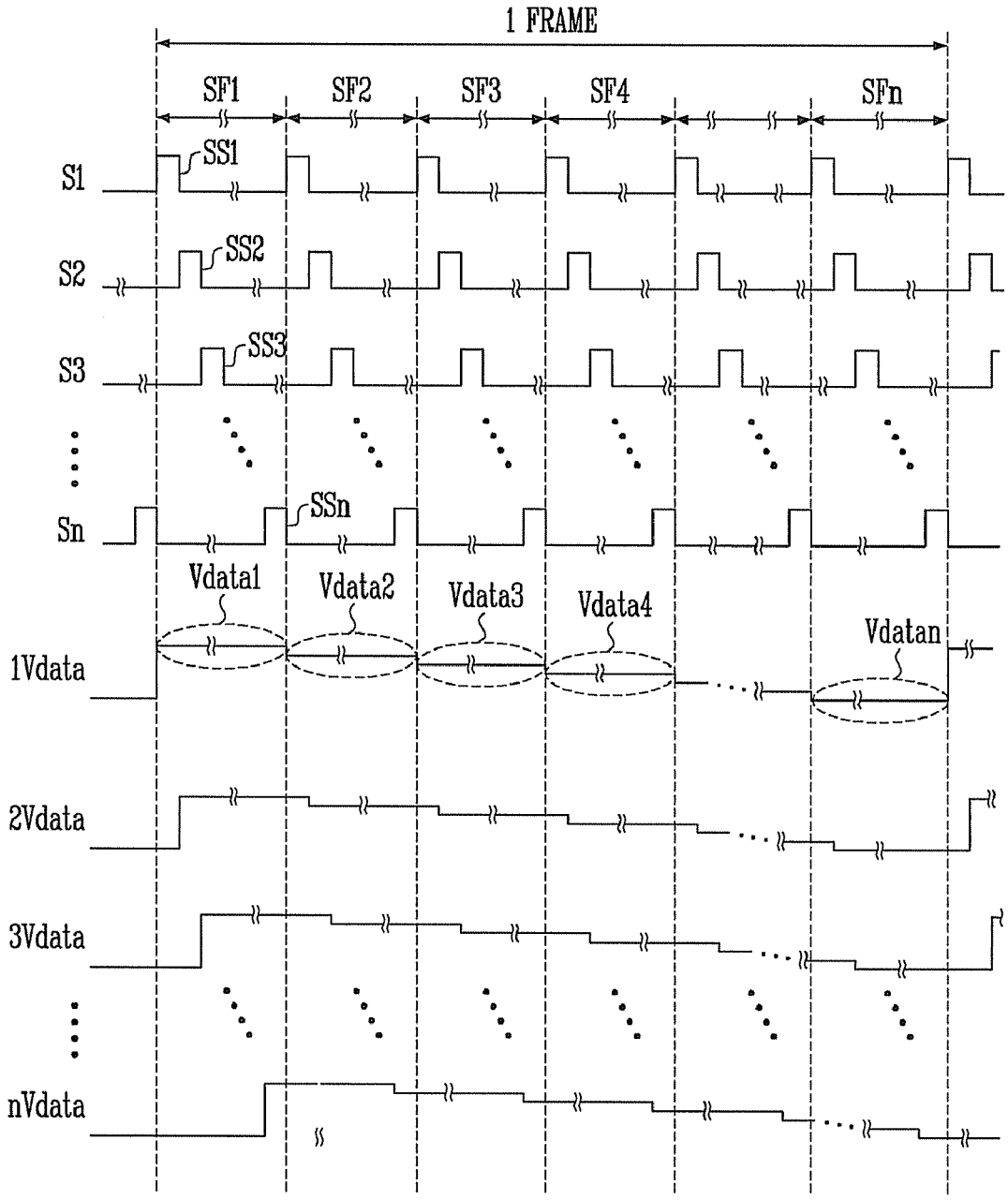
FIG. 7 is a waveform view showing a method of driving the pixel as shown in FIG. 6.

FIG. 6 is a view of a circuit showing another aspect of the pixel used in the organic electroluminescence display as shown in FIG. 3. FIG. 7 is a waveform view showing a method of driving the pixel as shown in FIG. 6. As shown in FIG. 6 and FIG. 7, the pixel includes first and second transistors (M1 and M2) and a capacitor (Cst). Here, the first and second transistors (M1 and M2) are implemented using an n-type metal-oxide semiconductor (NMOS) transistor, and their operations are carried out in a similar manner as in the aspect of the present invention as shown in FIG. 4.

That is, the pixel according to this aspect of the present invention and the organic electroluminescence display including the same of FIG. 6 are referred to as N-type transistors. Accordingly, when the scan signal and the data signal are in a high state, then the transistors will be in an ON state, and if the scan and data signals are in a low state, then the transistors will be in an OFF state. In this aspect of the present invention, the operation of the pixel using the n-type transistors can be easily carried out by those skilled in the art using the descriptions of the aspects of the present invention according to FIG. 6 showing the transistors implemented by p-type transistors.

Meanwhile, although the above descriptions of the aspects of the present invention disclose that each subframe has the same emission period, in other aspects, the subframes may have a different emission period from that of each other for the purposes of grey level presentation and image improvement. Also, the organic electroluminescence display having the pixel that controls a current to display an image, and the organic electroluminescence display having the pixel including an IR-drop (voltage drop) compensation circuit may be also utilized in a similar manner as described above.

Figure 8:
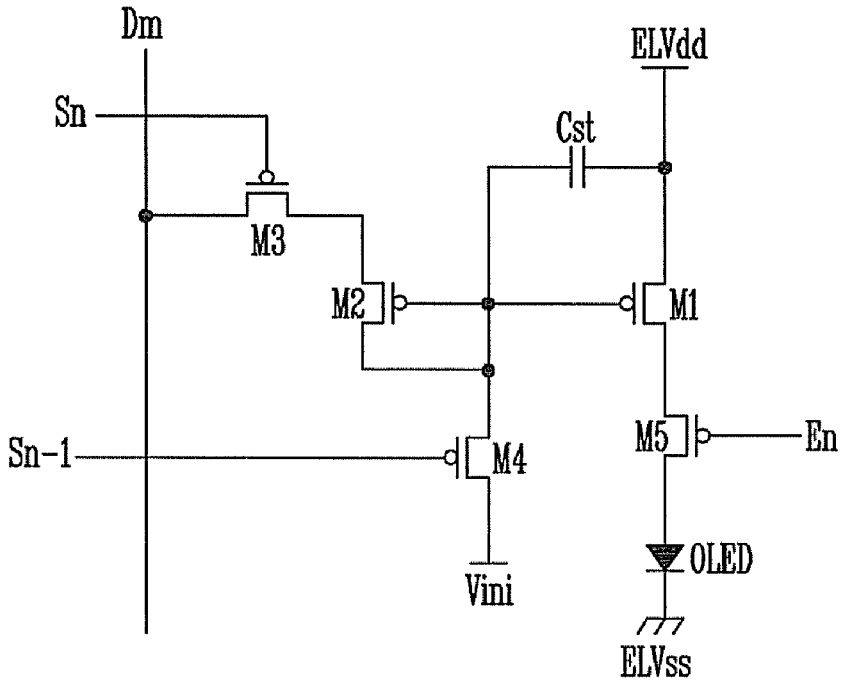
FIG. 8 is a view of a circuit showing a current-driving pixel used in the organic electroluminescence display according to an aspect of the present invention.

Accordingly, FIG. 8 is a view of a circuit showing a current-driving pixel used in the organic electroluminescence display according to an aspect of the present invention. As shown, the pixel includes first to fifth transistors (M1 to M5), a capacitor (Cst), and an organic electroluminescence device (OLED). The organic electroluminescence display is operated by receiving a first scan signal (sn), a second scan signal (sn1), and a reset voltage (Vini).

During operation of this aspect, when the fourth transistor (M4) receives the second scan signal (from sn−1), the fourth transistor (M4) will be in an ON state, causing the reset voltage (Vini) to be transmitted to a first electrode of the capacitor (Cst) to reset the voltage stored in the capacitor (Cst). Also, when the first scan signal (from Sn) is transmitted to the third transistor (M3), the third transistor (M3) will be in an ON state, and cause the source and the gate electrode of the second transistor (M2) to be set to the same voltage so that the second transistor (M2) makes a diode connection. At this time, since the data signal flows through the data line (Dm), a current corresponding to the data signal flows to the third transistor (M3) through the second transistor (M2). Also, since the gate electrode of the first transistor (M1) and the gate electrode of the second transistor (M2) are connected to each other, the first transistor is turned on and a current, which flows from the source to the drain of the first transistor (M1), is determined by the ratios of the voltage difference between the gate electrode of the first transistor (M1) and the gate electrode of the second transistor, for example. If the voltage, which corresponds to a value of the current flowing from the source to the drain of the first transistor (M1), is stored in the capacitor (Cst), then the current may flow from the source to the drain of the first transistor (M1) even though the second transistor (M2) is in an OFF state in accordance with the first scan signal (Sn). Also, if the fifth transistor (M5) is in an ON state in accordance with the emission control signal, then the current, which flows from the source to the drain of the first transistor (M1), flows to the organic electroluminescence device (OLED). Accordingly, the organic electroluminescence device emits light. In various aspects, the pixel emits light if the waveform as shown in FIG. 4 is transmitted to the pixel.

Figure 9:
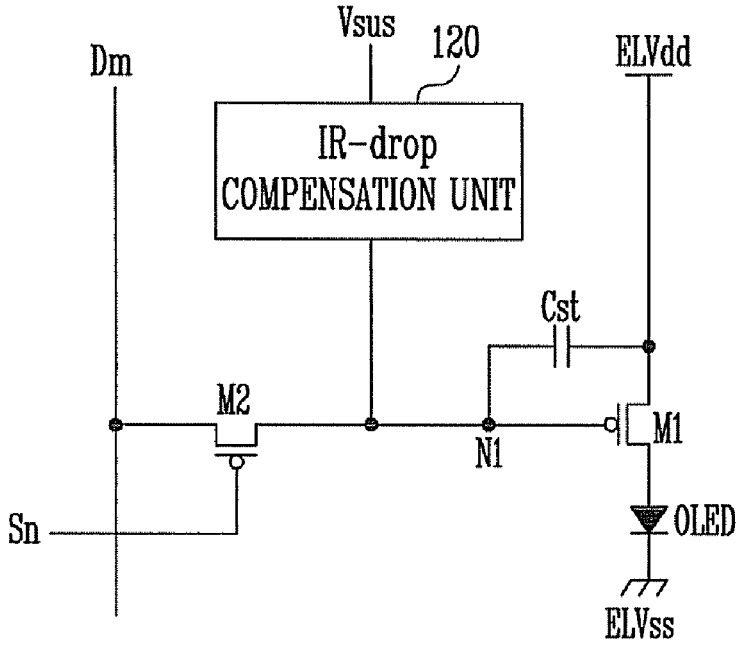
FIG. 9 is a view of a circuit showing a pixel having an IR-drop compensation circuit used in the organic electroluminescence display according to an aspect of the present invention.

FIG. 9 is a view of a circuit showing a pixel having an IR-drop (voltage drop) compensation circuit used in the organic electroluminescence display according to an aspect of the present invention. As shown, the IR-drop compensation circuit 120 is included in the pixel circuit shown in FIG. 3, but such inclusion is not required. Accordingly, the pixel may be operated by receiving the waveform, as shown in FIG. 4 and a variation due to the unevenness of the voltage of the power supply may be overcome by using the compensation power supply (Vsus) transmitted to the pixel. Also, a power line to transmit the compensation power (Vsus) is preferably formed in parallel to the scan line.

The organic electroluminescence display according to aspects of the present invention and the driving method thereof includes transmitting a data driving voltage to a data driving unit to make different a voltage of the data signal outputted from the data driving unit, the data driving voltage outputting different voltages of a digital data signal, the data driving signal being different voltages in every subframe according to the digital data signal. The organic electroluminescence display displays a desired grey level of an image by allowing a desired subframe to emit light corresponding to the number of bits of the digital data signal.

Accordingly, the organic electroluminescence display according to aspects of the present invention may be useful to minimize an unevenness phenomenon of an image due to variability of the transistor by combining an analog driving mode with a digital driving mode to allow the organic electroluminescence device to emit light. Also, the organic electroluminescence display according to aspects of the present invention may be useful to ensure the time period used to display a grey level of each subframe is maintained by setting emission periods of the subframes that corresponds to each bit of the N-bit digital data signal to the same level in the digital driving mode.

Although a few aspects of the present invention have been shown and described, it would be appreciated by those skilled in the art that changes might be made in the aspects without departing from the principles and spirit of the invention, the scope of which is defined in the claims and their equivalents.

What is claimed is:

1. An organic electroluminescence display comprising:

a plurality of scan lines to transmit a scan signal;

a plurality of data lines to transmit a digital data signal; and a plurality of pixels defined by a plurality of power supply lines to supply power, wherein the scan signal is transmitted during each of a plurality of subframes, and ON signals of the digital data signal have different voltages in each of the plurality of the subframes.

2. The organic electroluminescence display according to claim 1, wherein each of the pixels displays a desired grey level by summing the different brightnesses of each of the subframes.

3. The organic electroluminescence display according to claim 1, wherein the digital data signal has an N number of bits, and the plurality of the subframes has the N number of subframes.

4. The organic electroluminescence display according to claim 3, wherein a light-emitting subframe of the plurality of the subframes is determined by the bits of the digital data signal.

5. The organic electroluminescence display according to claim 1, wherein one of the plurality of pixels is operated in accordance with one of the bits of the digital data signal of each of the N subframes.

6. The organic electroluminescence display according to claim 1, further comprising a luminescent element, wherein one of the plurality of pixels comprises:

a first transistor to transmit a current corresponding to a voltage between a gate and a source of the first transistor from one of the power supply lines to the luminescent element;

a second transistor controlled by the scan signal supplied from one of the scan lines to output the digital data signal supplied from one of the data lines; and a capacitor to store one of the voltages of the digital data signal from the second transistor and to store the voltage between the gate and the source of the first transistor according to the stored voltage of the digital data signal.

7. The organic electroluminescence display according to claim 6, wherein one of the plurality of pixels further comprises a compensation circuit connected to a gate of the first transistor to compensate for a variation of a voltage transmitted from the power supply line.

8. The organic electroluminescence display according to claim 1, further comprising a luminescent element, wherein one of the plurality of pixels comprises:

a first transistor to transmit a current corresponding to a voltage between a gate and a source of the first transistor from one of the power supply line to the luminescent element;

a second transistor comprising a drain, and a gate that is connected to the gate of the first transistor and having voltages of the gate and the source of the second transistor maintained at the same level, and to allow a predetermined current to flow to a drain of the second transistor in accordance with the voltage between the gate and the source of the first transistor;

a third transistor controlled by the scan signal supplied from one of the scan lines and receiving the predetermined current flowing through the second transistor and transmitting the predetermined current to one of the data lines;

a capacitor to store a voltage corresponding to the predetermined current flowing through the second transistor and transmitting the predetermined current to the gate of the first transistor;

a fourth transistor to transmit a reset voltage to the capacitor;

a fifth transistor to control the current supplied from the first transistor to the luminescent element in accordance with an emission control signal.

9. An organic electroluminescence display comprising:

a pixel unit including a plurality of pixels defined by, a plurality of scan lines to which a scan signal is transmitted, a plurality of data lines to which a digital data signal is transmitted, a plurality of emission control lines to which an emission control signal is transmitted, and a plurality of power supply lines for supplying power;

a data driving unit to receive an n-bit digital data signal to transmit each bit of the n-bit digital data signal to the data lines, wherein the data driving unit receives different data driving voltages during each of a plurality of subframes;

a scan driving unit to transmit a scan signal that is transmitted during each of the plurality of the subframes, to the plurality of scan lines; and a control unit to generate the n-bit digital data signal and the different data driving voltages and to transmit the generated digital data signal and the different data driving voltages to the data driving unit.

10. The organic electroluminescence display according to claim 9, wherein each of the pixels displays a desired grey level by summing the different brightnesses of each of the subframes.

11. The organic electroluminescence display according to claim 9, wherein the digital data signal has an N number of bits, and the plurality of the subframes has the N number of subframes.

12. The organic electroluminescence display according to claim 11, wherein a light-emitting subframe of the plurality of the subframes is determined by bit values of the digital data signal.

13. The organic electroluminescence display according to claim 9, wherein one of the plurality of pixels is operated in accordance with one of the bits of the digital data signal of each of the N subframes.

14. The organic electroluminescence display according to claim 9, further comprising a luminescent element, wherein one of the plurality of pixels comprises:

a first transistor to transmit a current corresponding to a voltage between a gate and a source of the first resistor from one of the power supply lines to the luminescent element;

a second transistor controlled by the scan signal supplied from one of the scan lines and to output the digital data signal supplied from one of the data lines; and a capacitor to store one of the voltages of the digital data signal from the second transistor and to store the voltage between the gate and the source of the first transistor according to the stored voltage of the digital data signal.

15. The organic electroluminescence display according to claim 14, wherein one of the plurality of pixels further comprises a compensation circuit connected to a gate of the first transistor to compensate for a variation of a voltage transmitted from the power supply line.

16. The organic electroluminescence display according to claim 9, further comprising a luminescent element, wherein one of the plurality of pixels comprises:

a first transistor to transmit a current corresponding to a voltage between a gate and a source of the first transistor from one of the power supply lines to a luminescent element;

a second transistor comprising a drain, and a gate that is connected to the gate of the first transistor and having voltages of the gate and the source maintained at the same level, and to allow a predetermined current to flow to the drain of the second transistor in accordance with the voltage between the gate and the source of the first transistor;

a third transistor controlled by the scan signal supplied from one of the scan lines and receiving the predetermined current flowing through the second transistor and transmitting the current to one of the data lines;

a capacitor to store a voltage corresponding to the predetermined current flowing through the second transistor and transmitting the predetermined current to the gate of the first transistor;

a fourth transistor to transmit a reset voltage to the capacitor;

a fifth transistor to control the current supplied from the first transistor to the luminescent element in accordance with an emission control signal.

17. A method of driving an organic electroluminescence display, comprising:

classifying one frame into a plurality of subframes and transmitting a scan signal during each of the subframes;

setting an ON-state voltage of an n-bit digital data signal to each of the subframes at a different voltage level; and determining a light-emitting subframe out of the plurality of subframes in accordance with a bit value of the n-bit digital data signal.

18. The method of driving an organic electroluminescence display according to claim 17, wherein the organic electroluminescence display emits a different brightness light in each of the subframes.

19. A pixel of an electroluminescence device, comprising:

a scan line to receive a scan signal;

a data line to receive a data signal; and a transistor to control flow of current according to the data signal containing a data driving voltage component of different voltage levels to express brightness, wherein the data driving voltage component contains different voltages relative to each of a plurality of subframes, and wherein the data signal is a digital data signal that has an N number of bits and the plurality of the subframes has the N number of subframes.

20. A method of driving a pixel of an electroluminescence device, comprising:

receiving a scan signal;

receiving a data signal; and controlling the flow of current according to the data signal containing a data driving voltage component of different voltage levels to express brightness in the pixel, wherein the data driving voltage component contains different voltages relative to each of a plurality of subframes, and wherein the data signal is a digital data signal that has an N number of bits and the plurality of the subframes has the N number of subframes.

* * * * *